United States Patent [19]

Blankenship

[11] Patent Number: 4,996,735

[45] Date of Patent: Mar. 5, 1991

[54] PAINT DESIGN APPLICATOR

[76] Inventor: Linda C. T. Blankenship, P.O. Box 35, Soldotna, Ala. 99669

[21] Appl. No.: 376,676

[22] Filed: Jul. 7, 1989

[51] Int. Cl.[5] ..... B05C 1/06; B05C 7/16

[52] U.S. Cl. ..... 15/210 R; 15/145; 101/373

[58] Field of Search ..... 15/208, 209 R, 210 R, 15/210.5, 145; 101/333, 368, 372, 373

[56] References Cited

U.S. PATENT DOCUMENTS

| | | | |
|---|---|---|---|
| 106,468 | 8/1870 | Crossley | 101/372 |
| 866,723 | 9/1907 | Hill | 101/373 |
| 1,340,512 | 5/1920 | Wild | 101/372 X |
| 2,810,148 | 10/1957 | Wood, Jr. | 15/210 |
| 2,835,196 | 5/1958 | Herbert | 101/333 |
| 2,837,757 | 6/1958 | Katanich | 15/246 |
| 2,877,483 | 3/1959 | Alvistur | 15/210 |
| 3,284,832 | 11/1966 | McIver | 15/103 |
| 3,625,149 | 12/1971 | Allen | 101/373 |
| 3,973,404 | 8/1976 | Morrison et al. | 101/373 |
| 4,455,705 | 6/1984 | Graham | 15/121 |

FOREIGN PATENT DOCUMENTS 1440684 4/1966 France .

*Primary Examiner*—Chris K. Moore

*Attorney, Agent, or Firm*—Lane, Atkin & McCann

[57] ABSTRACT

An applicator for applying a paint design along the border of a wall includes a holder having a planar base, a handle extending from one side of the base and a hook-and-loop fastener on an opposite side of the base for attaching in any desired position a sponge or other member for holding paint and applying it to the wall. The hook-and-loop fastener carries a grid so that the paint holding and applying member can be located in a precise position on the base of the holder relative to edges of the base and to other paint holding and applying members.

14 Claims, 2 Drawing Sheets

PAINT DESIGN APPLICATOR

BACKGROUND OF THE INVENTION

The present invention relates to a paint applicator and, more particularly, to a hand-held applicator for imprinting paint designs on surfaces, especially along the borders of walls.

One method of enhancing the appearance of a room is to apply a border design along the top of the walls of the room, adjacent the ceiling, and perhaps along the juncture with the adjacent side walls, or in other places. Border designs have been provided on strips of wallpaper for complementing a primary wallpaper design. In addition, stencils are available for applying border designs, especially on painted walls. In both cases, the work involves handling thin, usually long, strips of paper or other material. Furthermore, the designs provided by the paper are fixed so that, at most, a limited variation in the design can be made.

SUMMARY OF THE PRESENT INVENTION

By the present invention, a paint design applicator is provided which enables the imprinting with paint of a wide variety of designs along the border of a wall, with precision and without the need for handling long strips of paper or other unwieldy apparatus.

The applicator includes a holder defining a planar base having a curved handle projecting from one side and an attachment device secured to the other side for releasably attaching paint applying members of any desired shape. The attachment device covers substantially the entire surface of the base and, in the preferred embodiment, comprises a portion of a hook-and-loop attachment device, one type of which is available under the trade name Velcro. The other portion of the hook-and-loop device is a part of the paint applying members, secured to a surface of one or more sponges so that the sponges may be releasably attached in any position on the base of the applicator in any orientation so that a desired pattern may be imprinted on the wall. A grid comprising lines regularly spaced at known intervals is formed on the attachment device secured to the applicator base so that the paint applying members can be precisely positioned relative to one another and relative to the edges of the applicator base. In this manner, an edge of the base can be positioned against the surface of the ceiling, adjacent side wall or other adjoining surface to assure that the design imprinted by the sponge or sponges can be repeated at a uniform distance from the ceiling, side wall or other adjoining surface.

DETAILED DESCRIPTION OF THE PREFERRED EMBODIMENT

Figure 1:
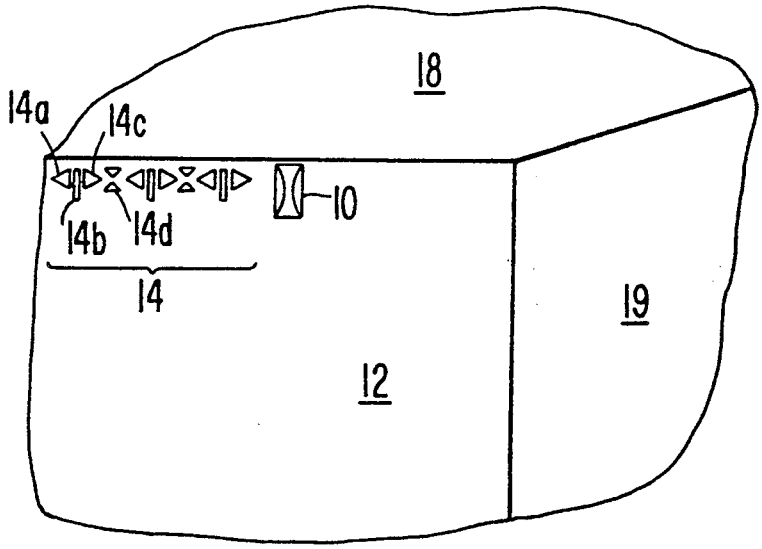
FIG. 1 is a perspective view of the paint design applicator according to the present invention forming a border design on a wall.
Figure 3:
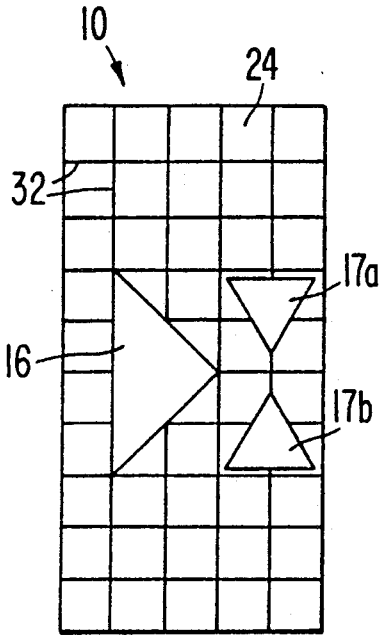
FIG. 3 is a rear view of the paint design applicator of FIG. 2, showing a releasably attached paint applying member.
Figure 4:
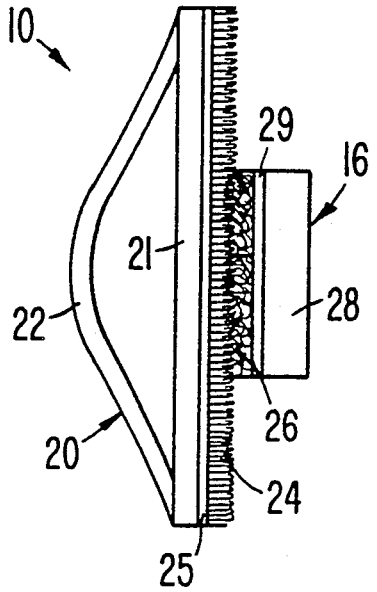
FIG. 4 is a side view of the paint design applicator of FIG. 2, with a paint applying member releasably attached.

FIG. 1 shows a paint design applicator, which is designated generally by the reference numeral 10, in position against a wall 12 of a room for forming a border design 14 comprising a plurality of border design elements 14*a*, 14*b*, 14*c* and 14*d*. Each of the design elements 14*a*–14*d* is applied by a paint applying member attached to a side of the applicator 10 facing the wall 12 (FIGS. 3 and 4). The triangular members 16, 17*a* and 17*b* are examples of the paint applying members. An edge of the applicator 10 engages a ceiling 18 of the room so that each design element 14*a*–14*d* imprinted at the same distance below the ceiling 18 as other design elements of the same type. Different design elements in the design 14 can be imprinted at the same level as each other, or at different levels, depending on preference. Furthermore, different design elements can be applied using different color paint, and even the same design element can be applied in different places using different color paint. A design can also be imprinted on the wall 12 along its border with a side wall 19, uniform distancing from the side wall being provided by engaging the side wall with an edge of the applicator 10.

Figure 2:
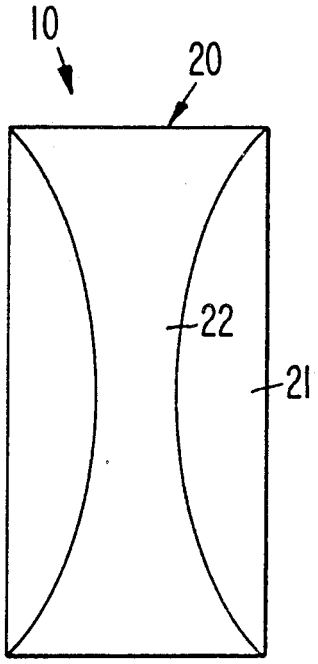
FIG. 2 is an enlarged front view of the paint design applicator of FIG. 1.

As can best be seen from FIGS. 2–4, the applicator 10 comprises a holder 20 including a planar base 21 and a handle 22 attached to the base. The base defines opposite sides and edges extending between the opposite sides, and the handle 22 has ends attached at opposite edges of the base 21, on one side of the base, the handle 22 curving outwardly from one point of attachment to the other. The curved shape of the handle 22 and its attachment at opposite edges of the planar base 21 help a person using the applicator 10 to apply an even pressure over the entire surface of the applicator. As can best be seen from FIG. 2, the handle 22 also narrows from its attachment at the edges of the base 21, where the handle extends substantially across the entire width of the base, to a narrow portion at the center of the handle. In a preferred embodiment, the planar base 21 and the handle 22 are formed in one piece from a suitable plastic.

On a side of the planar base 21 opposite to the handle 22, a releasable attachment device 24 extends over substantially the entire area of the base 21. The releasable attachment device 24 preferably comprises a portion of a hook-and-loop fastener, one type of which is available under the trade name Velcro. Such attachment devices typically include two portions, each of which is a piece of material. One portion comprises a large number of cross fibers or loops defining openings, and the other portion comprises a large number of relatively stiff, yet deformable, hooks which force their ways through the loops or among cross fibers to hold the two portions together. A separating force greater than a predetermined amount will cause the elements of the two portions to deform, allowing the portions to separate. The releasable attachment device 24, which is the portion of the hook-and-loop fastener covering the base 21 of the handle 10, is attached to the base 21 by a permanent adhesive 25 or other securing mechanism. The thickness of the adhesive 25 in FIG. 4 is greatly exaggerated for purposes of illustration.

Figure 5:
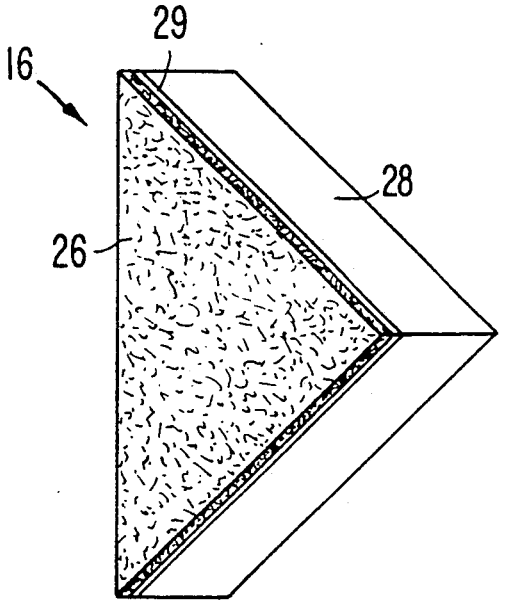
FIG. 5 is a perspective view of a paint applying member suitable for attachment to the paint design applicator.

The other portion 26 of the hook-and-loop fastener is part or a paint applying device 16, as can be seen from FIGS. 4 and 5. Each paint applying member 16, 17*a* and 17*b* comprises the portion 26 of the hook-and-loop fastener and a sponge 28 or other material capable of absorbing and holding paint and applying an even coat of paint to a wall or other surface. The second portion 26 of the hook-and-loop fastener is permanently attached to the paint applying member by an adhesive 29 or other securing mechanism, which holds the second portion 26 and the sponge 28 together with a greater force than is required to separate the two portions 24 and 26 of the hook-and-loop fastener. The paint applying devices 16, 17*a* and 17*b* can be provided in any desired shape, and sponges 28 lend themselves to being cut into various shapes. The paint applying devices 16, 17*a* and 17*b* cover an area less than the area of the planar base 21, and the area of the second portion 26 of the hook-and-loop fastener is coextensive with the area of the sponge 28 which applies the paint.

Some design elements having plural parts, such as the triangles of design element 14*d*, lend themselves to application by a single sponge, portions of the sponge between the two triangles of the design element being removed so that a space is left between painted shapes on the wall. The sides of the triangles facing away from one another are flush with the edges of the sponge so that the sponge can be properly placed on the holder 20 by using a grid 32 indicated on the attachment device 24.

As can be seen from FIG. 3, the attachment device 24, the portion of the hook-and-loop fastener mounted on the base 21 of the applicator 10, exhibits the grid 32 of parallel lines equally spaced at a known interval. For example, a first line of a series of parallel lines can be spaced one-half inch from one edge of the applicator base 21. The next line is spaced one-half inch from the first line, and so on across the base 21. Another series of parallel lines is arranged at 90 degrees with respect to the first series of lines, and the spacing between the lines can be the same as or different from the spacing of the first series of lines. The lines can be formed on the attachment device 24 by printing, or other form of providing a contrasting color relative to the major area of the attachment device, or by various other methods.

The grid 32 serves as a guide for placing paint applying members 16, 17*a* and 17*b* in certain positions relative to the edges of the of the applicator base 21. For example, if it is desired to apply one of the design elements 14*a*–14*d* to the wall 12 such that the top of the design element is spaced one and a half inches below the ceiling 18, the top of the paint applying member which will apply the appropriate design element is placed on the third grid line from the top edge of the applicator base 21. Then, after the sponge 28 has been dipped in paint, the top edge of the applicator base 21 is placed against the ceiling 18 as the sponge is brought into contact with the wall 12. By contacting the ceiling 18 with the edge of the applicator base 21 upon each application of the same design element, a uniform distance between the ceiling and the tops of the design elements is assured.

The distance between the ceiling 18 and the design elements 14*a*–14*d* can be varied in a predictable way by changing the position of the paint applying members 16, 17*a* and 17*b* relative to the lines of the grid 32. Furthermore, a plurality of paint applying members can be employed on the applicator 10 at one time, and the spacing between the paint applying devices can be measured using the grid 32. Furthermore, the grid 32 can be used to achieve uniform spacing between adjacent design elements 14*a*–14*d* in the design 14. For example, if it desired to leave an inch between a particular design element 14*d* and the next design element 14*a*, the paint applying member 16 which is appropriate for applying the second design element 14*a* is positioned on the attachment device 24 so that one edge of the design lies on the second grid line from an edge of the applicator base 21, assuming the lines are spaced one-half inch apart and one-half inch from the edge of the base 20. Then, when the sponge 28 has been dipped in paint, one edge of the applicator base 21 is placed in contact with the ceiling 18, and another edge of the applicator base 21, which lies at 90 degrees to the first edge, is placed on the edge of the previous design element 14*d* already imprinted on the wall. In this manner, uniform spacing between adjacent design elements can also be provided. The method just described for achieving uniform spacing assumes that the paint applying member 16 is secured to the applicator 10 at a different time from the paint applying members 17*a* and 17*b* which produce the design element 14*d*, rather than together as is shown in FIG. 3.

Although a specific preferred embodiment of the present invention has been described and illustrated herein, it is intended to be illustrative rather than limiting, and various modifications may be made without departing from the spirit and scope of the present invention, which is defined in the appended claims. For example, the applicator according to the present invention has been described as using paint, but it is understood that it can be used with other marking media.

I claim:

1. A device for supporting paint applying members in order to apply a paint design to a wall or other surface, comprising:

a holder having a planar base defining edges and opposite sides, and a handle extending from one of said sides;

means secured to a side of the planar base opposite to said handle for releasably attaching a paint applying member to said holder in any desired position on the side of the planar base opposite to said handle; and means for indicating precise positions on said holder for locating a paint applying member, said indicating means comprising a grid.

2. The device according to claim 1, wherein said releasable attaching means comprises a portion of a hook-and-loop type fastener.

3. The device according to claim 2, wherein said grid is on said portion of a hook-and-loop fastener.

4. The device according to claim 3, wherein said grid comprises equally spaced parallel lines.

5. The device according to claim 4, wherein the parallel lines include lines spaced from an edge of said planar base by a distance equal to the spacing between said parallel lines.

6. The device according to claim 1, wherein said handle has a curved surface extending from one edge of said planar base to an opposite edge of said planar base.

7. The device according to claim 1, further comprising a paint applying device releasably attached to said releasable attaching means.

8. The device according to claim 7, wherein said paint applying device comprises means for holding paint and applying paint to a surface.

9. The device according to claim 8, wherein said paint holding and applying means comprises a sponge.

10. The device according to claim 8, wherein said releasable attaching means comprises a first portion of a hook-and-loop type fastener, a second portion of the fastener being secured to said paint holding and applying means.

11. An applicator for applying a paint design to a wall or other surface, comprising:

a holder having a planar base defining edges and opposite sides and a handle extending from one of said sides;

a paint applying member having an area smaller than the area of said planar base; and means secured to a side of the planar base opposite to said handle for releasably attaching said paint applying member to said holder in any desired position on the side of said planar base opposite to said handle.

12. The applicator according to the claim 11, further comprising means for indicating precise positions on said planar base for locating the paint applying member.

13. A kit for applying a paint design to wall or other surface, comprising:

a holder having a planar base defining edges and opposite sides, and a handle extending from one of said sides;

means secured to the side of the planar base opposite to said handle for releasably attaching a paint applying device to said holder in any desired position on the side of the planar base opposite to said handle;

means for indicating precise positions on said releasable attaching means for locating a paint applying member; and a plurality of paint applying members having various shapes.

14. The device according to claim 11, comprising a plurality of paint applying members releasably attached to said holder.

* * * * *